US009409830B1

(12) United States Patent
Csernica et al.

(10) Patent No.: US 9,409,830 B1
(45) Date of Patent: Aug. 9, 2016

(54) NON-TOXIC PRIMER MIX

(71) Applicants: Christopher M. Csernica, Port Murray, NJ (US); Karl D. Oyler, New York, NY (US); Jesse J. Sabatini, Bel Air, MD (US); Neha Mehta, Succasunna, NJ (US)

(72) Inventors: Christopher M. Csernica, Port Murray, NJ (US); Karl D. Oyler, New York, NY (US); Jesse J. Sabatini, Bel Air, MD (US); Neha Mehta, Succasunna, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/882,803

(22) Filed: Oct. 14, 2015

Related U.S. Application Data

(63) Continuation-in-part of application No. 14/672,680, filed on Mar. 30, 2015, now abandoned.

(51) Int. Cl.

| | |
|---|---|
| ***C06B 47/10*** | (2006.01) |
| ***C06B 33/00*** | (2006.01) |
| ***C06B 31/00*** | (2006.01) |
| ***C06B 31/02*** | (2006.01) |
| ***D03D 23/00*** | (2006.01) |
| ***D03D 43/00*** | (2006.01) |
| ***C06B 25/34*** | (2006.01) |
| ***C06B 45/00*** | (2006.01) |

(52) U.S. Cl.
CPC ..... *C06B 25/34* (2013.01); *C06B 31/02* (2013.01); *C06B 45/00* (2013.01)

(58) Field of Classification Search
USPC ..... 149/22, 37, 45, 61, 108.6
See application file for complete search history.

(56) References Cited

U.S. PATENT DOCUMENTS

| | | | | |
|---|---|---|---|---|
| 3,973,502 | A * | 8/1976 | Olsen | F42C 19/10 102/204 |
| 7,833,330 | B2 * | 11/2010 | Fronabarger | C07D 257/06 106/1.13 |
| 2009/0223401 | A1 * | 9/2009 | Fronabarger | C06C 7/00 102/202.7 |

OTHER PUBLICATIONS

Fronabarger, John W. et al., DBX-1 A Lead Free Replacement for Lead Azide, Propellants, Explosives Pyrotechnics, Wiley-VCH Verlag GmbH & Co, KGaA, 2011, 36, 541-550, Weinheim.

Fronabarger, John W. et al., KDNP—A Lead Free Replacement for Lead Styphnate, Propellants Explosives, Pyro., Wiley-VCH Verlag GmbH & Co, KGaA, 2011, 36, 459-470. Weinheim.

* cited by examiner

*Primary Examiner* — James McDonough
(74) *Attorney, Agent, or Firm* — Lisa H. Wang

(57) ABSTRACT

A non-toxic primer mix in which DBX-1 (copper(I) 5-nitrotetrazole) acts as the primary explosive portion of the primer. Furthermore, in this mix, boron carbide ($B_4C$) replaces the traditional frictionator/fuel, toxic antimony trisulfide. In addition, potassium nitrate replaces the toxic barium nitrate ($BaNO_3)_2$) as the oxidizer, providing an ignition flame from the primer in a pyrotechnic reaction. The non-toxic primer therefore embodies a lead-free, barium-free, antimony-free explosive material that can include added fuels, sensitizers, explosives and/or binders.

7 Claims, 2 Drawing Sheets

NON-TOXIC PRIMER MIX

FEDERAL INTEREST STATEMENT

The inventions described herein may be manufactured, used and licensed by the United States Government for United States Government purposes without payment of any royalties thereon or therefore.

RELATED APPLICATIONS

The present application is related to co-pending U.S. application Ser. No. 14/672,680 filed Mar. 30, 2015 which is incorporated herein in its entirety.

FIELD OF THE INVENTION

This invention relates to explosives, and particularly to a non-toxic primer that embodies a lead-free, barium-free, antimony-free explosive material, and that additionally includes added fuels, sensitizers, explosives and/or binders.

BACKGROUND OF THE INVENTION

A percussion primer is a critical energy transducer used for converting a mechanical impetus into rapid chemical energy for most armament ignition trains, in particular for small arms ammunition used by both commercial and military sectors. Primers contain impact and friction sensitive mixes adapted to the armament system of design and are usually composed of common explosives and pyrotechnic components that have gradually evolved over time.

Over 100 years ago, mercury fulminate-based formulations were the most commonly used primer mixes. In the 1920s, alternate priming mixes were found to replace mercury fulminate, as this previous composition was found to deteriorate rapidly under tropical conditions and cause potential health problems or concerns such as lethargy and nausea to the shooter after firing. However, the alternate mixes that were based on lead thiocyanate/potassium chlorate formulations, were soon recognized as detrimental to weapon barrels because of the formation of corrosive water soluble potassium chloride salts upon combustion. Later primer mixes developed in the 1950s were based on the primary explosive lead styphnate (in its normal form: lead(II) 2,4,6-trinitro-m-resorcinate), a substance, which is much, more stable than mercury fulminate.

Currently, the most commonly used primer mixes are chemical mixtures comprising at least a primary explosive, and pyrotechnic mixes comprising oxidizing agents and fuel source.

Primary explosives are essential components in primers as they are directly responsible for converting a relatively small stimulus (i.e., a small quantity of energy in the form of an impact, friction, shock, heat, or electrostatic discharge) into a large chemical energy release capable of igniting the fuel/oxidizer components of the mixture. In the case of primer formulations, the most common primary is lead styphnate (also known as lead trinitrorescorcinate), which has two commercially used chemical forms: "normal" lead styphnate (lead(II) 2,4,6-trinitro-m-phenylene dioxide, $C_6HN_3O_8Pb$), and "basic" lead styphnate (lead(II) hydroxide 2,4,6-m-phenylene dioxide, $C_6H_3N_3O_{10}Pb_2$). Both forms possess very similar performance and are often used interchangeably. Either form of lead styphnate generally requires the addition of a second primary explosive, tetrazene, in the formulation to enhance the primer's reliability.

Lead styphnate a primary explosive, may be combined with the weaker but more sensitive explosive tetrazene (1-(5-tetrazolyl)-3-guanyl tetrazene hydrate, also sometimes referred to as tetracene) to render the lead styphnate based primer composition sufficiently sensitive to percussion.

Unfortunately, regardless of such desirable explosive properties, the lead found in lead styphnate is both an acute and chronic toxin, and the human body has difficulty in removing it once it has been absorbed and dissolved in the blood. Also, the manufacturing of these lead-based primary explosives results in the production of significant quantities of highly toxic hazardous waste. Handling and use of these lead base primary explosives results in further exposure, as well as, the wide dissemination of lead containing combustion by-products.

Other additives in primer compositions also contribute to toxic effects in humans. For instance, barium nitrate, a common oxidizing agent chosen primarily for its low hygroscopicity can cause cardiac arrest and respiratory failure leading to death.

Numerous attempts have been made towards producing an effective, non-toxic primer composition. As used herein "non-toxic" is intended to mean a substance consisting essentially of materials that are not toxic heavy metals (such as lead or barium, known carcinogens or poisons, especially when vaporized, burnt or exploded as in the firing of an ammunition round).

In the production of non-toxic primer mixes, 2-diazo-4,6-dinitro phenol (DDNP) is often a preferred lead-free substitute for lead styphnate as the primary explosive. Like lead styphnate, DDNP typically is accompanied by tetrazene as a secondary primary explosive to render the composition sufficiently sensitive to percussion. However, DDNP-based mixes have not found military use in the U.S. and have largely been relegated to practice ammunition in the commercial sector. The primary reason for the lack of utility is DDNP's poor performance at low temperatures.

Alternate primer mix designs have focused on eliminating the primary explosive as well as ability to be manufactured through automation such as red phosphorus (RP) based primers and the nanothermite-based Metastable Intermolecular Composites (MIC) developed in the last 12 years for military primers. Red phosphorous reacts slowly with air and moisture to form highly toxic phosphine gas, and further can corrode brass, which is the most commonly used material for ammunition casings. MICs require metal nano-powders to function, and therefore possess significant inhalation safety concerns; they are further almost always based on nano-aluminum, which degrades in the presence of moisture and can have pyrophoric qualities.

U.S. Pat. No. 7,833,330, by Fronabager et al., discloses the use of DBX-1 (copper(I) 5-nitrotetrazolate) as a potentially useful-lead free substitute for lead azide. It is not hygroscopic, does not contain highly toxic metals, is thermally stable, functions well at ambient and cold temperatures, and possesses comparable sensitivity to lead azide and lead styphnate. Given that conventional wisdom in the field has held that lead azide, being a more brisant, less-heat-generating compound compared to lead styphnate, was not suitable for use in primer applications where flame, high temperature, and slag are desired outputs.

The United States Military armaments are subjected to rigor of high standard performance, stability, and cost assessments. Commercial primer manufacturers are attempting to develop non-toxic primer compositions to meet the strict evaluations set by the military. With a recent development of a direct lead azide replacement, DBX-1, and concurrent pyrotechnic exploration with new materials of commercial and military interest, primer mix design expands into new territory.

So, while there has been some progress in establishing a lead-free replacement for lead azide, there is still a need in the art for a lead-free, i.e., environmentally green (safe) replacement for the primer composition as a whole.

SUMMARY OF THE INVENTION

To fulfill the foregoing need in the art, the present invention describes a new non-toxic primer composition and associated method of preparation. The primer mix completely replaces heavy metal compounds and natural gum binders found in primer formulations, while still maintaining stringent military performance requirements.

This composition embodies a lead-free, barium-free, antimony-free explosive material, and that additionally includes added fuels, sensitizers, explosives and/or binders. The non-toxic primer composition (or mix) may include DBX-1 by itself, or in the presence of tetrazene (tetracene), as the primary explosives portion.

In a further embodiment, boron carbide, aluminum, and potassium nitrate are included as the pyrotechnic portion of the primer mix, where boron carbide and aluminum serve as non-toxic fuels for the non-toxic oxidizer of potassium nitrate in the production of ignition flame. Boron carbide also serves as a frictionator due to its highly abrasive qualities, thus enhancing the impact and friction sensitivity of the mix.

Table I below, illustrates a conventional (e.g., standard FA-956) primer formulation, compared to Table II below, which illustrates an exemplary primer mix according to one embodiment of the present invention:

TABLE I

| Material | Weight Percent |
|---|---|
| Lead Styphnate | 37 |
| Tetracene | 4 |
| Barium Nitrate | 32 |
| Antimony Sulfide | 15 |
| PETN | 5 |
| Aluminum Powder | 7 |

TABLE II

| Material Ideal | Function | Formulation (weight %) | Acceptable Range (weight %) |
|---|---|---|---|
| DBX-1 | Primary Explosive | 20 | 5-40 |
| Tetracene | Primary Explosive | 5.5 | 0-15 |
| Potassium Nitrate | Pyrotechnic | 59 | 25-70 |
| Boron Carbide | Pyrotechnic | 5.5 | 2-25 |
| Aluminum Powder | Pyrotechnic | 9 | 3-30 |
| Binder | Pyrotechnic | 1 | 0.1-2.0 |

The nature of the subject invention will be more clearly understood by reference to the following drawings, detailed description, and the appended claims.

BRIEF DESCRIPTION OF THE DRAWINGS

Further features and advantages of the present invention may be understood from the drawings in which.

DETAILED DESCRIPTION OF PREFERRED EMBODIMENTS

Figure 1:
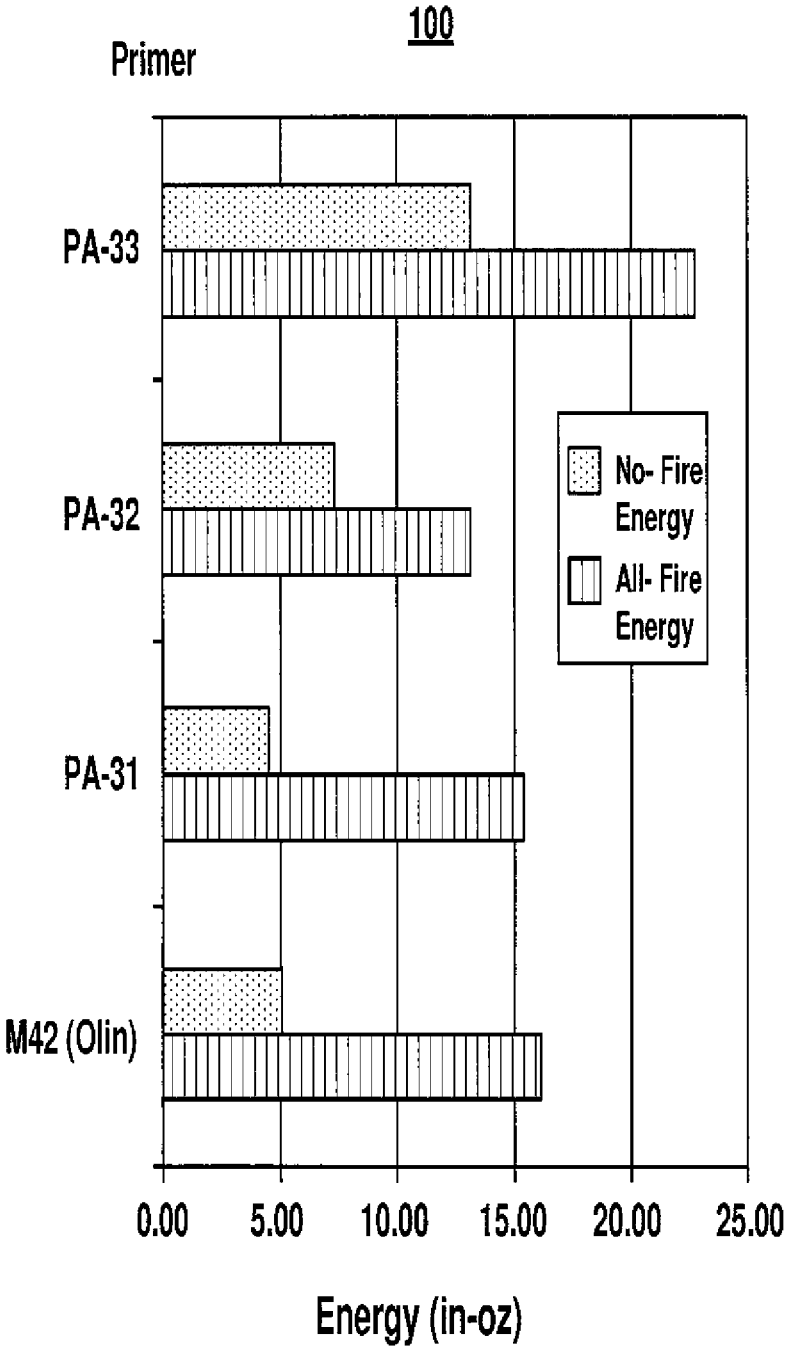
FIG. 1 is a graphical representation comparing the sensitivity of the present primer mix (PA-31, PA-32, PA-33) to that of a conventional lead styphnate-based mix (M42 (by Olin))

The present invention describes a new non-toxic primer composition (or mix) and associated method of preparation. In this primer mix, DBX-1 (copper(I) 5-nitrotetrazole) replaces lead styphnate and acts as the primary explosive portion of the primer. Boron carbide ($B_4C$) replaces the traditional frictionator/fuel, toxic antimony trisulfide. In addition, potassium nitrate replaces the toxic barium nitrate ($Ba(NO_3)_2$) as the oxidizer, providing an ignition flame from the primer in a pyrotechnic reaction.

Therefore, the primer mix completely replaces heavy metal compounds and natural gum binders found in primer formulations, while still maintaining military performance requirements. It embodies a lead-free, barium-free, antimony-free explosive material, which additionally can include added fuels, sensitizers, explosives and/or binders.

In one embodiment, the non-toxic primer mix may include DBX-1 by itself, or in the presence of tetrazene (tetracene), as the primary explosives portion.

In a further embodiment, boron carbide, aluminum, and potassium nitrate are included as the pyrotechnic portion of the primer mix, where boron carbide and aluminum serve as non-toxic fuels for the non-toxic oxidizer of potassium nitrate in the production of ignition flame. Boron carbide also serves as a frictionator due to its highly abrasive qualities, thus enhancing the impact and friction sensitivity of the mix. Boron carbide having particle sizes of about 1 μm to about 7 μm are recommended for the compositions described herein as larger particle sizes are too sensitive to safely handle. In studies with coarse boron carbide (12-40 micron particle size) frequent initiations during the pressing operation of the test formulations into the M42 primer cups were observed. Reducing the particle size of the boron carbide to a more medium particle size (7-20 microns) reduced the frequency of these unwanted initiations, but not to a safety-acceptable level. Employing a fine particle size of boron carbide (1-7 microns) removed this issue, allowing for the consistent pressing of primer formulations into the M42 primer cups without incident as indicated in Table ill below.

TABLE III

| Boron Carbide Type | Average Size Range (microns) | Comments |
|---|---|---|
| Fine | 1-7 | No initiations (Acceptable) |
| Medium | 7-20 | Initiations observed (Not acceptable) |
| Coarse | 12-40 | Initiations observed (Not acceptable) |

Additionally, metal fuels (including, but not limited to, magnesium, magnalium, titanium, zirconium, silicon, phosphorus, sulfur, boron, and compounds thereof), and oxidizers (including, but not limited to metal oxides, metal peroxides, metal nitrates, metal nitrites, metal iodates, metal periodates, metal oxides, metal phosphides, and metal sulfides), can be included as the pyrotechnic portion of the primer mix.

In still another embodiment, tetrazene can be left out completely, and substituted with an additional, coarse-particle boron carbide, ground glass, or another abrasive, in order to render a high-temperature-resistant primer formulation.

More specifically, an embodiment of the present inventive primer mix is preferably composed of:

(1) about 5 to about 60 weight percent DBX-1, preferably about 5 to about 40 weight percent DBX-1, and most preferably about 20 weight percent DBX-1;

(2) about 25 to about 70 weight percent potassium nitrate, more preferably about 60 weight percent potassium nitrate;

(3) about 2 to about 25 weight percent boron carbide, more preferably about 5 to 15 weight percent boron carbide, and most preferably about 5.5 weight percent boron carbide having particle size of about 1 μm to about 7 μm;

(4) about 3 to about 30 weight percent aluminum, more preferably about 5 to 10 weight percent aluminum, and most preferably about 9 weight percent aluminum; and (5) about 0 to about 15 weight percent tetrazene (tetracene), more preferably about 2 to 10 weight percent tetrazene, and most preferably about 5.5 weight percent tetrazene.

An alternative embodiment of the primer includes additional fuels such as: nitrocellulose, metal fuels, organic fuels, metal oxides, metal peroxides, metal nitrates, metal nitrites, metal iodates, metal periodates, metal phosphides, metal sulfides. and other organic compounds such as 5-aminotetrazole, pentaerythritol tetranitrate (PETN), 1,3,5-trinitro-1,3,5-triazacyclohexane (RDX), 1,3,5,7-tetranitro-1,3,5,7-tetraazacyclooctane (HMX), 2,4,6,8,10,12-hexanitro-2,4,6,8,10,12-hexaazaisowurtzitane (CL-20), and trinitrotoluene (TNT).

According to another alternative embodiment, the primer mix includes any one or more of: pentaerythritol tetranitrate (PETN), 1,3,5-trinitro-1,3,5-triazacyclohexane (RDX), 1,3,5,7-tetranitro-1,3,5,7-tetraazacyclooctane (HMX), potassium 4,6-dinitrobenzofuroxan (KDNBF), potassium 4,6-dinitro-7-hydroxybenzofuroxan (KDNP), 2,-diazo-4,6-dinitrophenol (DDNP), cyanuric triazide (CTA), CL-20, trinitrotoluene (TNT), or other explosive materials, as a primary explosive and/or gas generator.

According to still another embodiment, the primer mix includes any one or more of: Gum arabic, Celvol, CAB, Epoxy, polyester resins, xanthum gum, and other related materials, as a binder.

FIG. 1 is a graphical representation comparing the sensitivity of the present primer mix (PA-31, PA-32, PA-33) to that of a conventional lead styphnate-based mix (M42 (by Olin)). FIG. 1 shows that the sensitivity of the present primer mix is almost equal to, or greater than the sensitivity of the conventional lead styphnate based mix.

Figure 2:
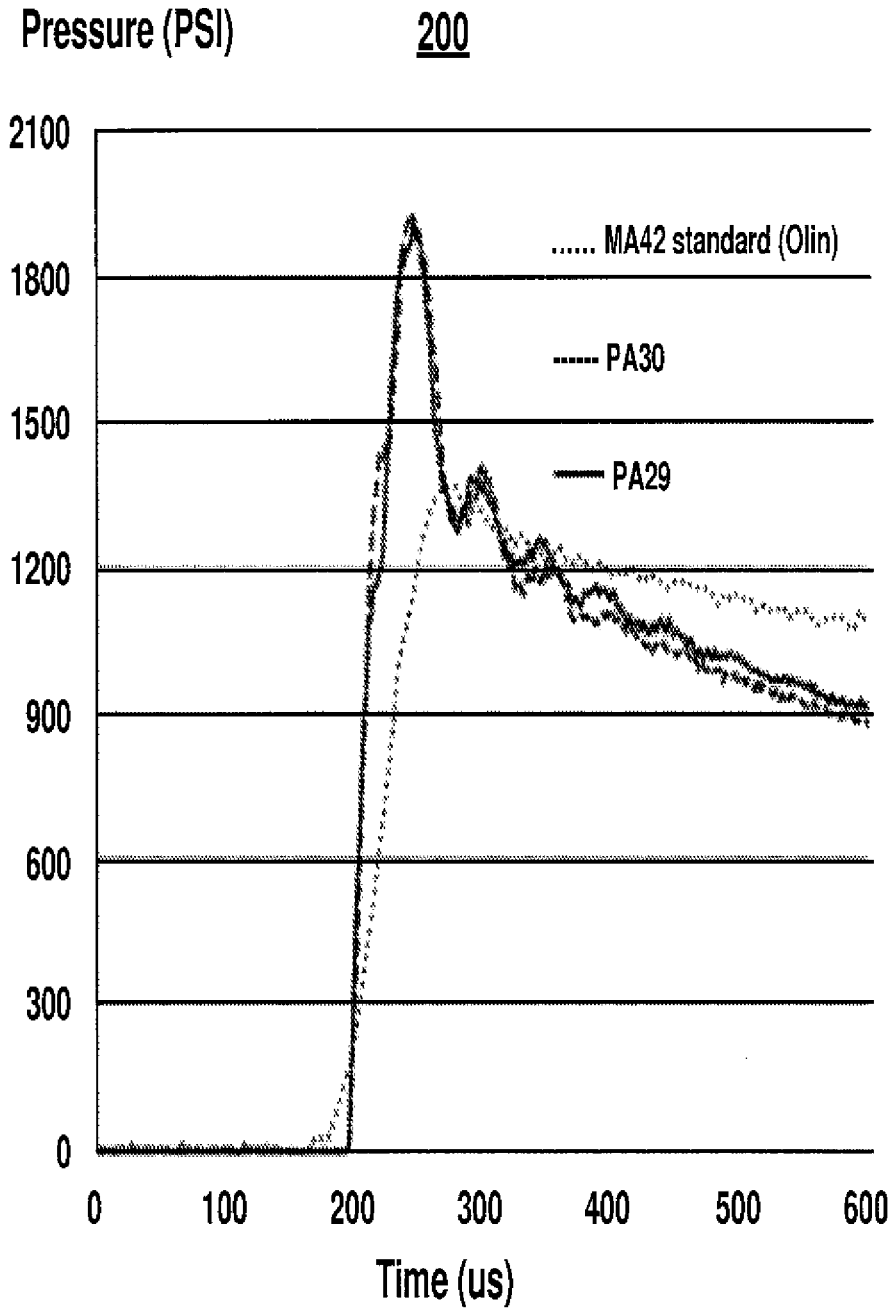
FIG. 2 is a graphical representation comparing the pressure performance of the present primer mix (PA-29, PA-30) to that of a conventional lead styphnate-based mix (M42 (by Olin)).

FIG. 2 is a graphical representation comparing the pressure performance of the present primer mix (PA-29, PA-30) to that of a conventional lead styphnate-based mix (M42 (by Olin)). FIG. 2 shows that the sensitivity of the present primer mix is greater than the pressure performance of the conventional lead styphnate based mix.

The method of preparing the present non-toxic primer mix preferably includes wet processed the primer mix during production for safety. The preparation method includes combining water and/or alcohol, DBX-1 (on a dry weight percent about 5% to about 60% by weight), potassium nitrate (about 25% to about 70% by weight), boron carbide (about 2% to about 25% by weight), aluminum (about 3% to about 30% by weight), and approximately tetrazene (about 0% to about 15% by weight), and then mixing the constituent compounds. The wet formed primer mix can then be rolled and charged into percussion cups.

The primer mix was loaded into multiple common primer platforms, such as the M42 primer (used in both lethal and non-lethal grenade fuzes), and tested for sensitivity, pressure output, response time, extreme temperature performance, and ability to reliably ignite common commercial and military propellants.

Table IV, below shows the formulation of the current US military NOL-130 stab mix, used in M55 detonators, the current US military M155 standard percussion primer (also known as FA-956 primer mix) used in small arms; an embodiment of the inventive DBX-1 based primer; and TTA and MIC based alternative lead-free primer primary explosive formulations:

TABLE IV

| Constituents | M115 Std. Small Arms Percussion Primer/FA-956 Primer | DBX-1 based inventive primer composition |
|---|---|---|
| Lead azide | | |
| DBX-1 | | 20 |
| Basic lead styphnate | | |
| Normal lead styphnate | 37 | |
| Barium Nitrate | 32 | |
| Tetrazene | 4 | 5.5 |
| Antimony(III) trisulfide | 15 | |
| PETN | 7 | |
| Aluminum powder | | 9 |
| Nano-Aluminum | | |
| Bismuth(III) oxide | | |
| Potassium nitrate | | 59 |
| boron carbide | | 5.5 |
| Binder | | 1 |

At this point, while we have discussed and described the invention using some specific embodiments, those skilled in the art will recognize that our teachings are not so limited. For example, the preferred embodiments of the invention have been provided for the purpose of explaining the principles of the invention and its practical application, thereby enabling others skilled in the art to understand the invention. Various embodiments and various modifications are contemplated.

What is claimed is:

1. A non-toxic primer explosive composition consisting essentially of a mixture of a primary explosive and pyrotechnic mix; wherein the primary explosive comprises DBX-1 and the pyrotechnic mix consists essentially of boron carbide having particle size of about 1 μm to about 7 μm; potassium nitrate; aluminum powder and a binder.

2. The non-toxic primer explosive composition of claim 1, wherein the primary explosive further comprises tetrazene.

3. The non-toxic primer explosive composition of claim 1, wherein the primary explosive further comprises any one or more compounds selected from the group consisting essentially of: potassium 4,6-dinitrobenzofuroxan (KDNBF), potassium 4,6-dinitro-7-hydroxybenzofuroxan (KDNP), 2,-diazo-4,6-dinitrophenol (DDNP), and cyanuric triazide (CTA).

4. The pyrotechnic mix of the composition of claim 1, wherein the binder is polyvinyl alcohol.

5. The pyrotechnic mix of the composition of claim 1, wherein the binder is a compound selected from a group consisting essentially of: gum arabic, Celvol, CAB, Epoxy, polyester resins, and xanthum gum.

6. A non-toxic primer explosive composition consisting essentially of a mixture of a primary explosive and a pyrotechnic mix wherein the primary explosive comprises about 5 to about 40 weight percent DBX-1; and the pyrotechnic mix consists essentially of about 5 to about 15 weight percent boron carbide having a particle size of about 1 μm to about 7

μm; about 25 to about 70 weight percent potassium nitrate; about 5 to about 10 weight percent aluminum; and a binder.

7. The non-toxic primer explosive composition of claim 6 wherein the primary explosive further comprises about 2 to about 10 weight percent tetrazene.

* * * * *